US005967601A

United States Patent [19]

Gillins

[11] Patent Number: 5,967,601

[45] Date of Patent: Oct. 19, 1999

[54] SUNSHADE APPARATUS FOR RECREATIONAL CHAIR

[76] Inventor: Gary Gillins, P.O. Box 62, Minersville, Utah 84752

[21] Appl. No.: 09/076,439

[22] Filed: May 12, 1998

[51] Int. Cl.[6] ..... A47C 7/66

[52] U.S. Cl. ..... 297/184.15; 135/96; 297/184.1

[58] Field of Search ..... 297/184.15, 184.1, 297/184.11, 184.13; 248/214, 539, 541, 201; 403/399, 398, 391, 397; 135/96, 88.1, 88.12, 117, 119

[56] References Cited

U.S. PATENT DOCUMENTS

| | | | |
|---|---|---|---|
| 2,837,140 | 6/1958 | Hedman | 297/184.11 X |
| 3,243,230 | 3/1966 | Otto | 297/184 |
| 3,438,651 | 4/1969 | Hertoghe et al. | 248/539 X |
| 3,738,703 | 6/1973 | Kunimatu | 297/184 |
| 4,230,363 | 10/1980 | Borichevsky | 297/184.15 |
| 4,300,798 | 11/1981 | Musgrove et al. | 297/184 |
| 4,635,667 | 1/1987 | Harn | 135/90 |
| 4,639,036 | 1/1987 | Nichols | 297/184 |
| 4,865,381 | 9/1989 | Van Rogue | 297/184 |
| 5,000,210 | 3/1991 | Worthington, Jr. | 297/184.15 X |
| 5,013,085 | 5/1991 | Craig | 297/184 |
| 5,022,420 | 6/1991 | Brim | 297/184.1 X |
| 5,096,257 | 3/1992 | Clark | 297/184 |
| 5,135,281 | 8/1992 | Pappalardo | 297/184.15 |
| 5,203,363 | 4/1993 | Kidwell et al. | 135/96 X |
| 5,538,311 | 7/1996 | Fusco et al. | 296/97.5 |
| 5,551,660 | 9/1996 | Leduchowski | 248/541 X |

*Primary Examiner*—Peter M. Cuomo
*Assistant Examiner*—Stephen Vu
*Attorney, Agent, or Firm*—Madson & Metcalf

[57] ABSTRACT

A sunshade apparatus is disclosed for use with recreational chairs having a seat back. The sunshade has a rigid support to which upper edge clips and side edge clips are connected for releasable attachment to the seat back upper edge and seat back side edge, respectively. The side edge clips can rotate about the support in a generally horizontal plane, and the side edge clips are constructed in a manner to flex in a generally vertical plane. The upper edge clips have a hook portion to enable the sunshade to hang on the seat back upper edge. A canopy frame, covered with a shade producing cover, is pivotally attached to the support. When not in use, the canopy frame can be pivoted to a collapsed, generally flat configuration with the support.

11 Claims, 4 Drawing Sheets

SUNSHADE APPARATUS FOR RECREATIONAL CHAIR

FIELD OF THE INVENTION

The present invention relates sunshade apparatus. More particularly, the present invention relates to a sunshade apparatus that can be attached to a variety of different sizes and styles of recreational chairs.

BACKGROUND

Recreational chairs of various types, such as lawn chairs, patio chairs, lounge chairs, and the like, are known. With the growing awareness of the harm caused by excessive sun exposure, there has been increased interest in developing sunshades for use with recreational chairs.

Large umbrellas have been used for many years to provide shade for recreational chairs. However, large umbrellas are often too bulky and obtrusive for many uses. Smaller canopy sunshades have been proposed in the art. These sunshades have been clamped to recreational chairs using specially designed clamps, brackets, and gears. Some sunshades have been manufactured integral with the chair. Most of the known sunshade devices are not capable of being used on a differently sized chairs. Many of the specially designed clamping devices fail to provide the strength and stability needed to support the sunshade. Furthermore, Most of the existing sunshade devices cannot be quickly attached to and removed from the recreational chair.

There is, therefore, a need in the art for a sunshade apparatus for recreational chairs which can be quickly attached to and removed from differently sized chairs. There is also a need in the art for a recreational chair sunshade apparatus which is strong and stable in operation.

Such recreational chair sunshade is disclosed and claimed herein.

SUMMARY OF THE INVENTION

The present invention is directed to a sunshade apparatus for use with recreational chairs having a seat back with an upper edge and a pair of side edges. The sunshade apparatus within the scope of the present invention hangs on the upper edge of the seat back and is clipped onto the seat back side edges.

The sunshade apparatus includes a rigid U-shaped support which is designed to be disposed generally vertically or substantially parallel to the seat back. The U-shaped support has a pair of upper edge clips which releasably attach to the seat back upper edge and a pair of side edge clips which releasably attach to the seat back side edges. The side edge clips are preferably loosely connected to the U-shaped support such that they are able to rotate about the U-shaped support in a generally horizontal plane. The side edge clips are also constructed in a manner to flex in a generally vertical plane. The vertical and horizontal movement of the side edge clips enables the sunshade apparatus to be used with a variety of different sized recreational chairs. The upper edge clips and side edge clips are preferably constructed of a polymeric material.

A canopy frame is preferably pivotally attached at one end of the U-shaped support. The canopy frame is preferably pivoted between a collapsed configuration and an operative configuration. In a preferred collapsed configuration, the canopy frame is parallel to and nested within or without the U-shaped support. In a preferred operative configuration, the canopy frame is generally perpendicular to the U-shaped support. A removable, shade-producing cover is disposed over the canopy frame.

A support bracket extending between the U-shaped support and the canopy frame is preferably provided to hold the canopy frame in the operative configuration.

DESCRIPTION OF THE INVENTION

Figure 1:
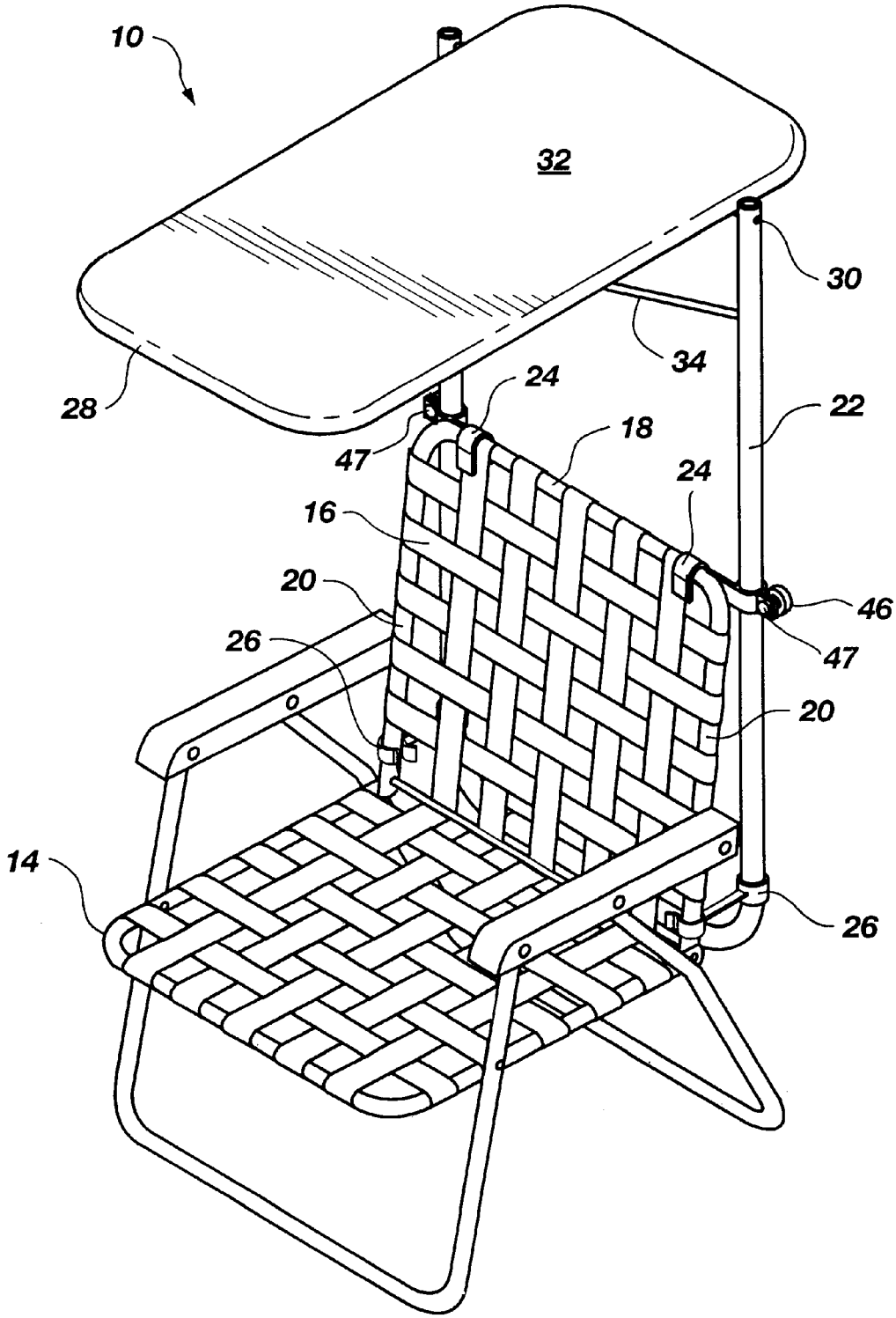
FIG. 1 is a perspective view of a sunshade apparatus within the scope of the present invention attached to a typical lawn chair.

The present invention will now be described with reference to the figures. FIG. 1 shows a sunshade apparatus 10 within the scope of the present invention attached to a recreational chair 14 having a seat back 16 with an upper edge 18 and a pair of side edges 20. Although the sunshade apparatus 10 is shown in connection with a typical recreational chair 14, it will be appreciated that the sunshade apparatus can be used with other chairs not shown in the figures, such as wheel chairs, lifeguard chairs, stadium chairs, etc. The sunshade apparatus within the scope of the present invention hangs on the upper edge 18 of the seat back 16 and is clipped onto the seat back side edges 20.

The sunshade apparatus includes a rigid support 22 which is designed to be disposed generally vertically or substantially parallel to the seat back 16. The support 22 has a pair of upper edge clips 24 which releasably attach to the seat back upper edge 18 and a pair of side edge clips 26 which releasably attach to the seat back side edges 20.

The side edge clips 26 are preferably loosely connected to the support 22 such that they are able to rotate about the support 22 in a generally horizontal plane. The side edge clips 26 are also constructed in a manner to flex in a generally vertical plane. The vertical and horizontal movement of the side edge clips 26 enables the sunshade apparatus 10 to be used with a variety of different sized recreational chairs.

Figure 3:
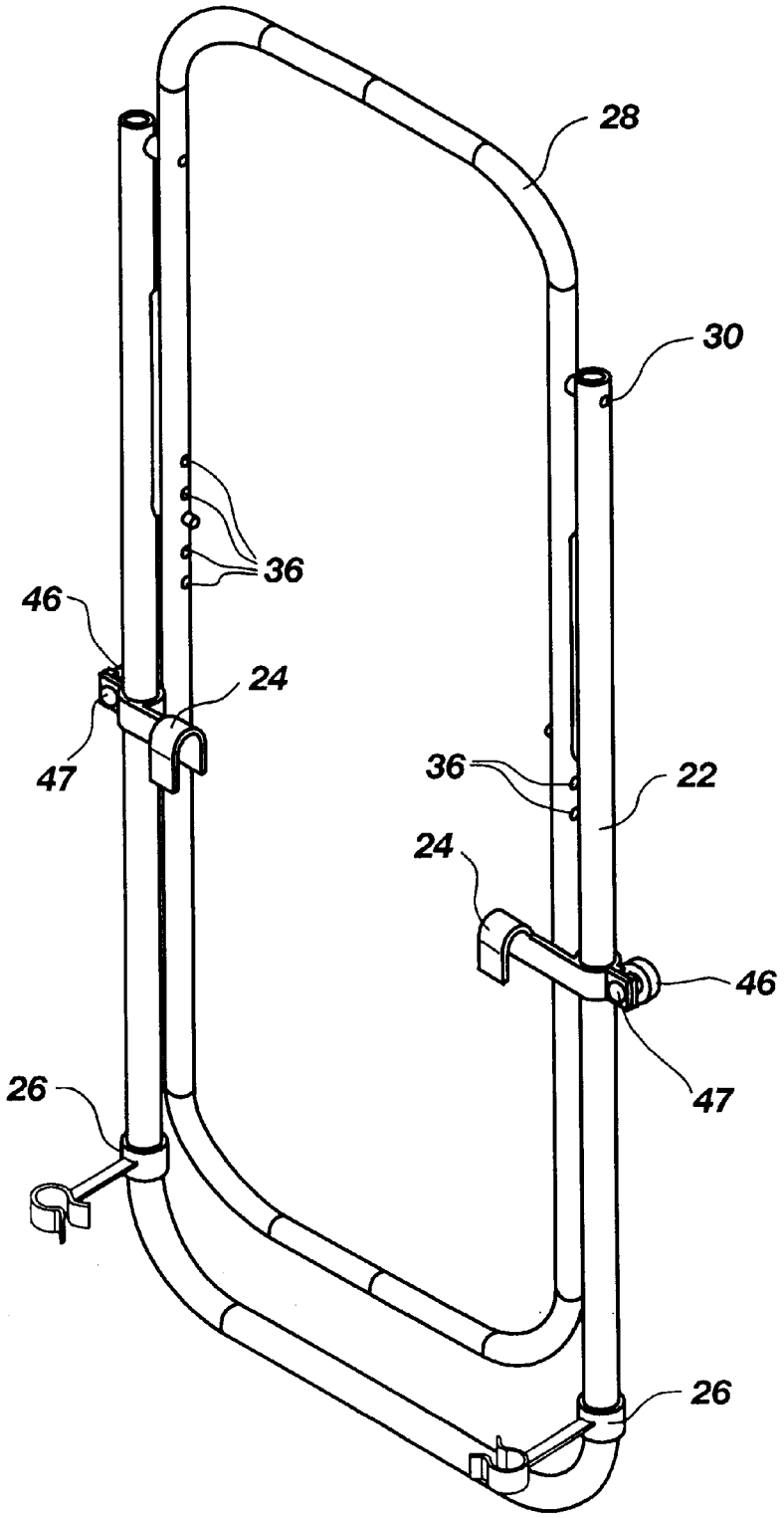
FIG. 3 is a perspective view of the sunshade apparatus shown in FIG. 2 in a collapsed, folded flat configuration.

A canopy frame 28 is preferably pivotally attached at one end of the support 22 with a pivot pin 30. The canopy frame 28 is preferably pivoted between a collapsed configuration and an operative configuration. In a preferred collapsed configuration, shown in FIG. 3, the canopy frame 28 is parallel to and nested with the support 22. Although the sunshade 10 embodiment of FIG. 3 shows the canopy frame nested within the support 22, one having ordinary skill in the art will appreciate that the canopy frame 28 can be larger such that the support 22 is nested within the canopy frame 28.

Figure 2:
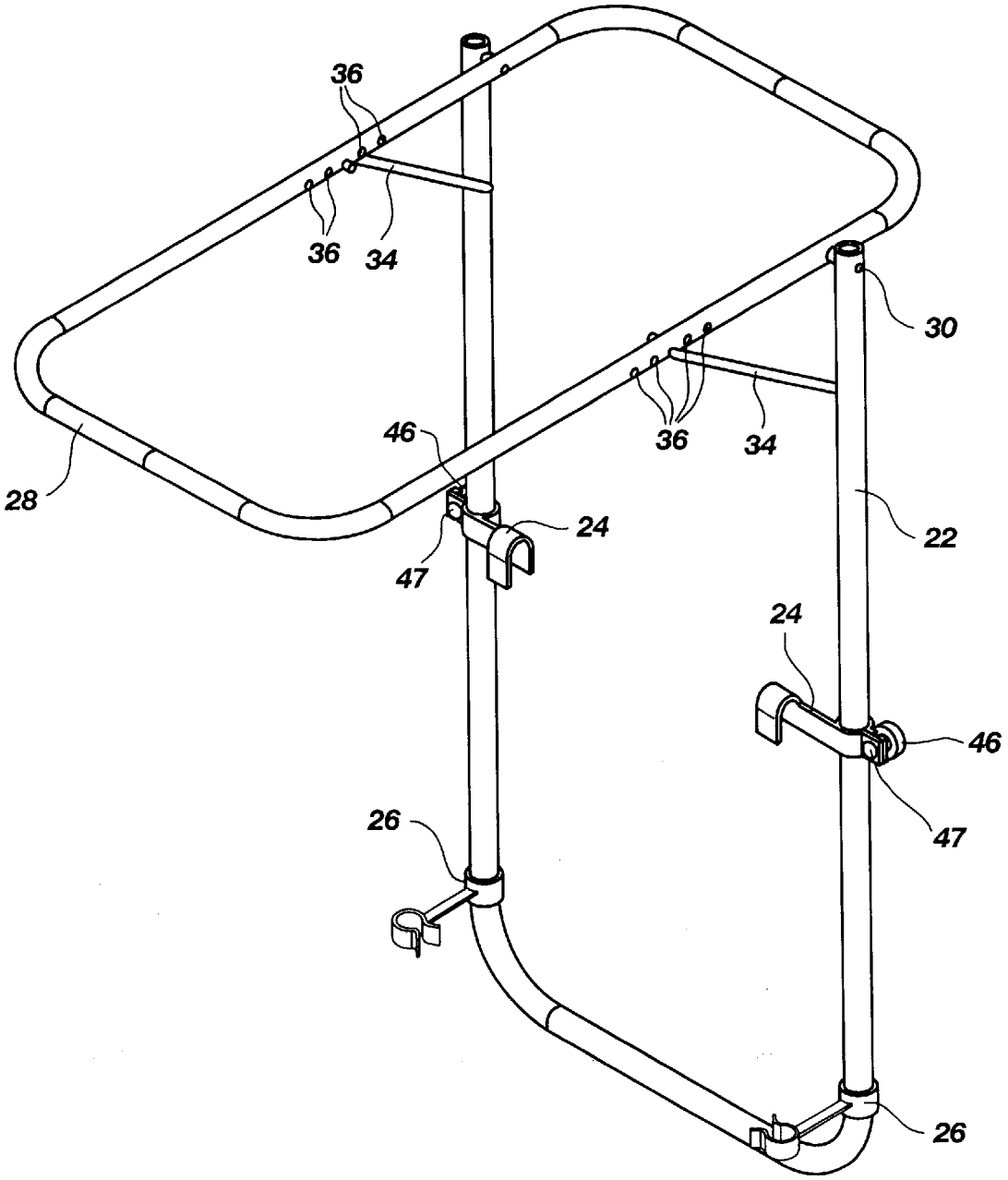
FIG. 2 is a perspective view of the sunshade apparatus shown in FIG. 1 detached from the lawn chair and having the shade material removed.

In a preferred operative configuration of sunshade 10, shown in FIGS. 1 and 2, the canopy frame 28 is generally perpendicular to the support 22. A shade-producing cover 32 is disposed over the canopy frame 28. The shade-producing cover 32 is preferably removable.

A support bracket 34 extending between the support 22 and the canopy frame 28 is preferably provided to hold the canopy frame 28 in the operative configuration. The support bracket 34 is preferably releasable to allow the sunshade apparatus 10 to be collapsed for storage or shipment. The support bracket 34, also preferably allows for adjustment of the pivot angle between the canopy frame 28 and the support 22. Holes 36 located in the canopy frame 28 can be used to adjust the pivot angle. Alternatively, holes can be located in support 22 to allow adjustment of the pivot angle. Adjusting the pivot angle enables the user to maximize and control the shade produced by the sunshade and to account for the reclining angle of different seat backs 16.

Although the support 22 shown in the figures is generally U-shaped, one having ordinary skill in the art will appreciate that the support 22 can have several different configurations. For instance, the support 22 can be "H" shaped, "I" shaped, "O" shaped, or any other configuration which allows the upper edge clips 24 to releasably attach to the seat back upper edge 18 and the side edge clips 26 to releasably attach to the seat back side edges 20.

Figure 4:
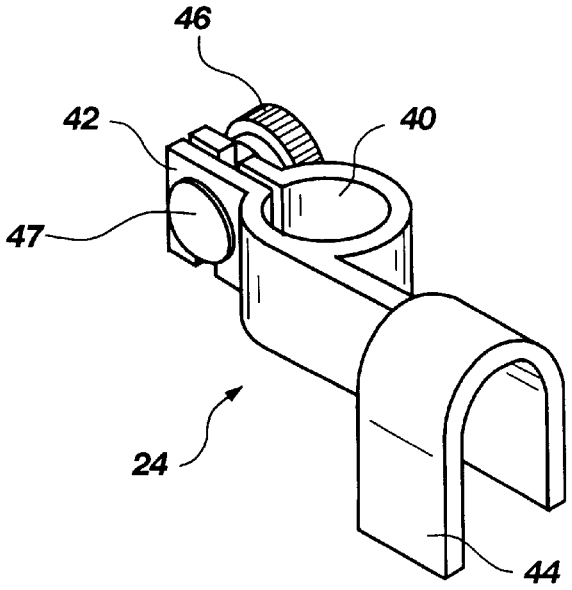
FIG. 4 is a perspective view of a top edge clip within the scope of the present invention.

FIG. 4 shows one currently preferred upper edge clip 24 which can be used in connection with the sunshade apparatus of the present invention. The upper edge clip 24 has a cylindrical portion 40 which fits around the support 22. A clamp 42 is provided to secure the cylindrical portion 40 to the support 22. Clamp 42 allows the upper edge clip to be adjusted along support 22 to accommodate different sized recreation chair seat backs 16. An adjustment knob 46 coupled to a lag screw 47 are provided to tighten or loosen the clamp 42. A variety of other knobs, screws, bolts, or other similar means can be used to tighten or loosen the clamp 42. The upper edge clip 24 includes a U-shaped hook 44 which fits over the seat back upper edge 18. The U-shaped hook 44 is preferably sized to permit its use with a variety of different seat back upper edges 18. The upper edge clips 24 are preferably constructed of a polymeric material, although other materials, such as metal, can be used.

Figure 5:
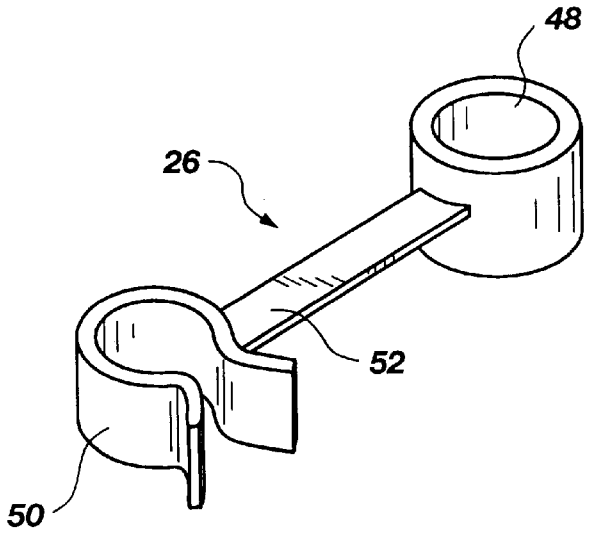
FIG. 5 is a perspective view of a side edge clip within the scope of the present invention.

FIG. 5 shows one currently preferred side edge clip 26 which can be used in connection with the sunshade apparatus of the present invention. The side edge clip 26 has a cylindrical portion 48 which fits around the support 22. The cylindrical portion 48 is sufficiently loosely connected to the support 22 to enable the side edge clip 26 to rotate about the support 22 in a generally horizontal plane. The side edge clip 26 includes a releasable clip 50 which is preferably sized to clip around a variety of differently sized seat back side edges 20. The releasable clip 50 is preferably C-shaped. A novel feature of the side edge clip 26 is a generally flat portion 52 joining the cylindrical portion 48 to the releasable clip 50. The generally flat portion 52 enables the side edge clip 26 to flex in a generally vertical plane. The vertical and horizontal movement of the side edge clips 26 enables the sunshade apparatus 10 to be used with a variety of recreational chairs having different seat back widths and reclining angles. The side edge clips 26 are preferably constructed of a polymeric material, although other materials, such as metal, can be used.

It will be appreciated that the present invention provides a sunshade apparatus for recreational chairs which can be quickly attached to and removed from differently sized chairs. The present invention also provides a recreational chair sunshade apparatus which is strong and stable in operation.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A sunshade apparatus for use with recreational chairs having a seat back with an upper edge and a pair of side edges, said sunshade apparatus comprising:

a rigid U-shaped support to be disposed generally vertically;

a pair of upper edge clips for releasable attachment to the seat back upper edge attached to the U-shaped support;

a pair of side edge clips for releasable attachment to the seat back side edges, said side edge clips comprising:

a cylindrical member rotatably secured to the U-shaped support;

a C-shaped clip for releasable attachment to the side edge; and a generally flat flexible connector joining said cylindrical member to said C-shaped clip to allow the side edge clips to flex;

a canopy frame pivotally attached at one end of the U-shaped support, wherein the canopy frame can be pivoted between a collapsed configuration parallel to and nested within the U-shaped support and an operative configuration generally perpendicular to the U-shaped support;

a support bracket extending between the U-shaped support and the canopy frame to hold the canopy frame in the operative configuration; and a removable shade-producing cover disposed over the canopy frame.

2. A sunshade apparatus as defined in claim 1, wherein the pair of upper edge clips are constructed of a polymeric material.

3. A sunshade apparatus as defined in claim 1, wherein the pair of side edge clips are constructed of a polymeric material.

4. A sunshade apparatus as defined in claim 1, wherein the upper edge clip comprises a U-shaped member configured to releasably attach to the seat back upper edge.

5. A sunshade apparatus as defined in claim 1, wherein the flat flexible connector is disposed in a non-vertical plane to allow the side edge clips to flex in a generally vertical plane.

6. A sunshade apparatus for use with recreational chairs having a seat back with an upper edge and a pair of side edges, said sunshade apparatus comprising:

a rigid support to be disposed generally vertically;

a pair of upper edge clips disposed on the support comprising a U-shaped member configured to releasably attach to the seat back upper edge;

a pair of side edge clips disposed on the support comprising:

a cylindrical member rotatably secured to the support;

a C-shaped clip configured to releasably attach to the seat back side edge; and a generally flat flexible connector joining said cylindrical member to said C-shaped clip, wherein the flat flexible connector is disposed in a non-vertical plane to allow the side edge clips to flex in a generally vertical plane;

a canopy frame pivotally attached at one end of the support, wherein the canopy frame can be pivoted between a collapsed configuration parallel to and nested with the support and an operative configuration generally perpendicular to the support; and a shade-producing cover disposed over the canopy frame.

7. A sunshade apparatus as defined in claim 6, further comprising a support bracket extending between the support and the canopy frame to hold the canopy frame in the operative configuration.

8. A sunshade apparatus as defined in claim 6, wherein the pair of upper edge clips are constructed of a polymeric material.

9. A sunshade apparatus as defined in claim 6, wherein the pair of side edge clips are constructed of a polymeric material.

10. A sunshade apparatus as defined in claim 6, wherein the shade producing cover is removable.

11. A sunshade apparatus as defined in claim 6, wherein the support is generally U-shaped.

* * * * *